United States Patent [19]

Trautsch

[11] 4,437,412

[45] Mar. 20, 1984

[54] FOLDING PALLET

[75] Inventor: Jerrold A. Trautsch, New Lisbon, Wis.

[73] Assignee: Leer Manufacturing Company, Inc., New Lisbon, Wis.

[21] Appl. No.: 386,236

[22] Filed: Jun. 8, 1982

[51] Int. Cl.[3] ..... B65D 19/12; A47B 43/00; F16D 1/12

[52] U.S. Cl. ..... 108/56.1; 108/55.3; 108/115; 211/201; 312/257 SK; 403/157; 403/161; 16/262; 16/386

[58] Field of Search ..... 108/56.1, 33.5, 55.1, 108/111, 55.3, 115; 312/258, 257 SK; 211/201, 182; 403/157, 158, 161; 16/257, 259, 262, 386

[56] References Cited

U.S. PATENT DOCUMENTS

| | | | |
|---|---|---|---|
| 657,661 | 9/1900 | Kinnear | 108/111 |
| 2,005,566 | 6/1935 | Schwabe . | |
| 2,660,328 | 11/1953 | Averill . | |
| 3,191,959 | 6/1965 | Heimbruch et al. . | |
| 3,327,889 | 6/1967 | Dore | 108/56.1 X |
| 3,552,761 | 1/1971 | Sjöblom | 108/56.1 X |
| 3,853,072 | 12/1974 | Skubic et al. . | |
| 4,027,599 | 6/1977 | Sapp et al. . | |
| 4,068,599 | 1/1978 | Sapp et al. . | |
| 4,209,183 | 6/1980 | Jones et al. . | |

FOREIGN PATENT DOCUMENTS

| | | | |
|---|---|---|---|
| 264047 | 8/1968 | Austria | 108/111 |
| 66885 | 10/1945 | Denmark | 312/258 |

*Primary Examiner*—Francis K. Zugel
*Assistant Examiner*—Peter R. Brown
*Attorney, Agent, or Firm*—Isaksen, Lathrop, Esch, Hart & Clark

[57] ABSTRACT

A folding pallet (10) is disclosed which has frame members including upright posts (11,12) base members (16) connecting the front and back posts at their bottoms, top side members (14) connecting the front and back posts (11,12) at their top ends, the top cross rods (17) and bottom cross rods (18) connected to and extending between the vertical posts (11,12) at their tops and bottoms, respectively. A bottom tray (20) is pivotally mounted to one of the bottom cross rods so that it can be moved from a horizontal position covering the bottom of the pallet to a vertical position out of interference with the folding of the various frame members. The vertical posts (11,12) are rotatably mounted to the base members (16) and top side members (14) so that when the tray is lifted up, the pallet can be folded to a flat configuration by drawing a diagonally opposed front post (11) and back post (12) together. The pallet is particularly suited to the folding and carrying of bagged material which can be stacked vertically upon the tray (20) within the framework defined by the vertical posts (11,12).

13 Claims, 7 Drawing Figures

FOLDING PALLET

TECHNICAL FIELD

This invention pertains generally to the field of carts and structures for temporary storage and conveyance of materials, such as pallets, and particularly to collapsible and foldable pallets.

BACKGROUND ART

A variety of platforms or other structures are commonly utilized for conveying and storing materials. An example is the common wooden pallet, which simply provides a base upon which materials may be stacked. The wooden pallet may be provided with upright rods and handles to further accommodate the products stacked upon the pallet and to facilitate handling during shipment. Wooden pallets are relatively cheap and therefore commonly used, but for certain types of applications they are unsanitary since they absorb and retain moisture; they are also heavy and are subject to rot and damage during handling. In addition, pallets which are provided with metal handles or rods are not readily stackable when the unloaded pallets are to be transported or stored, so that considerable time is spent assembling and disassembling the pallets before and after use.

There is also available a wide variety of commercially produced carts, carriages, and the like which may be utilized for holding materials during transportion and storage. In general, such carts and conveyances are not intended to substitute for the simple pallet, and usually are structurally stronger and quite often equipped with wheels so that they can be moved without the aid of mechanical assistance such as a handtruck, pallet truck or forklift. However, where only the simple holding of material for handling is necessary or desired, specially designed carts and carriages perform no better than a simple pallet and are, of course, substantially more expensive.

DISCLOSURE OF THE INVENTION

The folding pallet of the present invention is adapted for quick erection, so that it can be used in the transport and storage of various materials, and for similarly quick folding to a compact structure when the pallet is not in use. The pallet is particularly well suited to the handling of bagged bulk materials such as bagged ice, seed, fertilizer, rock salt and the like, since several bags of material may be stacked one atop the other and held in position on the pallet structure.

The pallet includes a framework of four parallel, vertical posts, two front posts and two rear posts; a top pair of parallel, horizontal side members to which the front and back posts are engaged at their tops; a pair of parallel, horizontal base members to which the posts are engaged at their bottom ends; and horizontal cross rods attached between the pairs of front and back posts at the bottoms and tops of the posts. The vertical posts, top side members, base members, and cross rods define a frame which, in its erect position, has the general form of a rectangular parallelepiped. The vertical posts are journaled for rotation to the top side members and base members so the posts can rotate about their own axes, and the cross bars are connected rigidly to the posts so that they can turn with respect to the top side members and base members. This manner of connection between the frame members allows the frame to be folded from its erected configuration to a substantially flat configuration for storage. A tray is pivotally connected to the back bottom cross rod so that it can rotate from a vertical position, parallel to the two back posts when the pallet is in its folded configuration, to a horizontal position parallel to the base members when the pallet is erected. The front of the tray in its horizontal position rests on the bottom front cross rod and thus is fully supported between the front and back bottom rods. The sides of the tray in its horizontal position will engage the front posts to thereby prevent the posts from moving so that the entire structure is rigid. Folding up of the pallet is accomplished very simply by drawing up the tray to its vertical position and pulling a pair of diagonally opposed posts toward each other until the pallet assumes its flat configuration.

The top side members preferably have a flat top and a raised flange along at least one edge so that the base members of another pallet can rest upon the top side members and can be held in place by the upright flanges. The top side members may further be formed as U-shaped channels, having a vertical web section and horizontal upper and lower flanges extending from the web. The upright restraining flange on the top side member would then extend from the outer edge of the upper horizontal flange of the channel member. To provide the rotatable mounting of the posts to the top side members, the lower flanges may have an opening therein for each post which is engaged to the side member, with a ferrule on the flange extending upwardly and surrounding the opening. The opening and the cylindrical interior of the ferrule have a diameter slightly larger than the outside diameter of the upright post. On the upper flange, directly above the ferrule on the lower flange, is formed a downwardly extending ferrule having an outside diameter slightly less than the inside diameter of the hollow, tubular posts. The post may thus be inserted through the opening in the lower ferrule and around the upper ferrule to thereby be held so that the post cannot be moved laterally but can nonetheless rotate about its axis. The post may be prevented from being drawn out of the channel member in various ways; preferably, a cross rod is engaged to the post at a position just above the top of the lower ferrule so that the rod engages the ferrule and prevents the post from coming out. The rotational engagement between the posts and the base members may be provided in the same manner as the engagement between the posts and the top side members.

The foldable pallet structure of the invention is thus readily and easily collapsed and erected; it can be formed of relatively thin and lightweight materials; and it may be folded to a very compact, substantially flat configuration for storage when the pallet is not being used. The pallet is particularly adapted to handling bagged materials which are of approximately the same length and width as the area between the upright posts, since the bags may be fitted in between the posts and thus held therein without the need for side wall structures. Of course, the pallet may be made in any desired size to best accommodate the material to be carried by the pallet. Since side walls are not necessary, the foldable pallet may utilize the minimum structure described above, thereby minimizing both weight and expense. A fully loaded pallet can be handled easily by a handtruck or forklift, since the base side members provide a flat lower surface which can be engaged by either a truck or forklift, and the loaded pallets can be stacked at least two high.

Further objects, features, and advantages of the invention will be apparent from the following detailed description taken in conjunction with the accompanying drawings showing a preferred embodiment of a folding pallet in accordance with the invention.

BEST MODE FOR CARRYING OUT THE INVENTION

Figure 1:
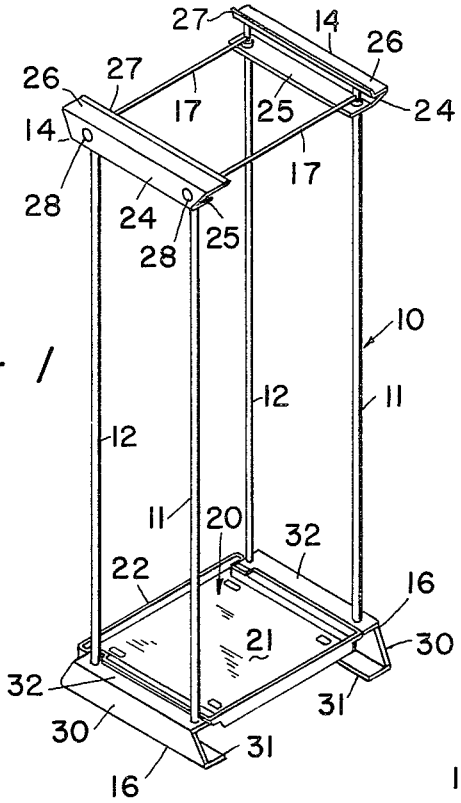
FIG. 1 is a perspective view of the folding pallet of the invention in erected configuration.

With reference to the drawings, a folding pallet in accordance with the invention is shown generally at 10 in FIG. 1. The frame of the pallet 10 includes a pair of vertical front posts 11 and a pair of vertical back posts 12 which are parallel to and spaced away from the front posts 11. The tops of the posts 11 and 12 are engaged by a pair of top side members 14, each side member 14 engaging the top of one of the front posts 11 and one of the back posts 12 along a side of the pallet. The posts 11 and 12 are also engaged at their bottoms by pair of base members 16, each base member 16 engaging the bottom ends of one of the front posts 11 and one of the back posts 12 along the sides of the pallet.

The posts 11 are also engaged near their tops by a pair of horizontal cross rods 17, one of the rods 17 attached to and extending between the front posts 11 and the other of the rods 17 attached to and extending between the back posts 12. A pair of bottom cross rods 18 and 19 (not shown in FIG. 1, but partially shown in FIG. 3) are similarly engaged to the posts 11 and 12 near the bottoms thereof. The front bottom rod 18 is attached to and extends between the front posts 11 and the back bottom rod 19 is attached to and extends between the back posts 12.

Figure 2:
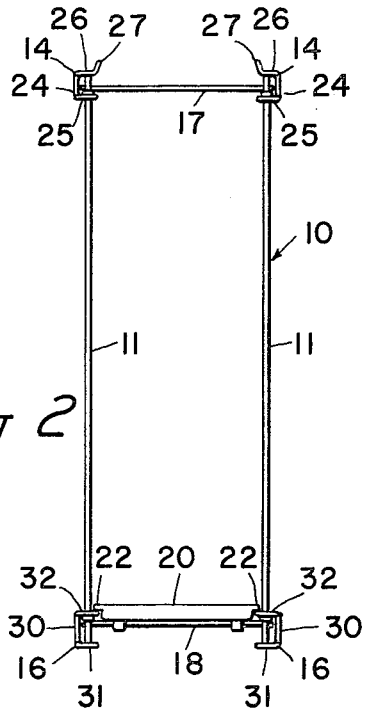
FIG. 2 is a front elevational view of the pallet of FIG. 1.

It is thus seen that in the erected position of the pallet, the posts 11 and 12, the members 14 and 16, and the cross rods 17, 18 and 19 define the edges of a rectangular parallelepiped shape. To support material within the erected pallet, a flat tray 20 occupies the bottom area of the pallet between the posts 11 and 12. The tray 20 is shown in its horizontal position in FIG. 1 in which it is substantially parallel to the base members 16. As shown, the tray 20 preferably has a bottom panel 21 which is surrounded by an upwardly extending lip 22. A pair of lugs 23 (one shown in FIG. 3) extend from the bottom of the tray 20 and each lug has an opening therein through which the cylindrical back bottom cross rod 19 passes. The tray 20 can thus pivot about the cross rod 19 from a horizontal position in which the tray rests its front end on the front bottom cross rod 18 to a vertical position, shown in FIG. 3, in which the tray is substantially parallel to and spaced outwardly from the back vertical posts so that the tray does not interfere with the folding of the pallet. As shown in FIG. 2, the raised lip areas 22 of the tray may be formed so that they overlie and rest upon the upper flanges 32 of the base members. The tray 20 provides a base on which various materials, such as bags of ice, may be stacked in the pallet. In one manner of using the pallet 10, the area within the posts 11 and 12, generally conforming to the area of the bottom panel 21 of the tray 20, may be substantially equal to the size of a bag of material to be stacked upon the pallet 10. For example, a first bag of ice may be laid on the tray 21 and forced into position such that the ends of the bag with material inside tightly engage against the posts 11 and 12. In particular, this can occur if the lateral dimensions of the filled bag are somewhat greater than the area of the tray bottom 21 so that the material within the bag must distort slightly to allow the bag to fit within the posts 11 and 12. Additional bags of ice may thereafter be stacked up in a similar manner between the posts 11 and 12 until a column of bags fills the pallet 10. The engagement of the sides of the bags with the posts 11 and 12 will prevent the bags from falling out as the pallet is picked up and transported to another location, and the pallet may also be used as a stand to hold the bags in a vertical position while they are being stored.

As shown in FIG. 2, the top side members 14 are formed as U-shaped channels, having a vertical web section 24 with a horizontal lower flange 25 and a horizontal upper flange 26 extending therefrom. An upright retaining flange 27 extends upwardly from the edge of the flat surfaced upper flange 26 along at least a portion of the length thereof. Holes 28 may be formed as shown in the web section 24 to allow a chain or clip to be passed through the holes 28 to connect together two adjacent pallets to allow them to be handled and moved together. The base members 16 have a similar U-shaped channel structure, including a central vertical web 30 section and horizontal lower and upper flanges 31 and 32 extending from the edges of the web. The flat lower flanges 31 of the base members are positioned to align with the flat top surfaces of the upper flanges 26 on the side members 14 so that the pallets 10 may be stacked one atop the other by resting the flanges 31 of an upper pallet on the top flanges 26 of a lower pallet. The upright retaining flanges 27 prevent the upper pallet in the stack from shifting and falling off of the surfaces of the upper flanges 26. Alternatively, a board or boards may be placed over the tops of several adjacent pallets in a first layer and then an additional layer of pallets may be placed on the board.

The loaded pallet can be picked up by various standard conveyances, such as handtrucks or dollies, since the loaded pallet forms a compact, unitary structure.

Figure 3:
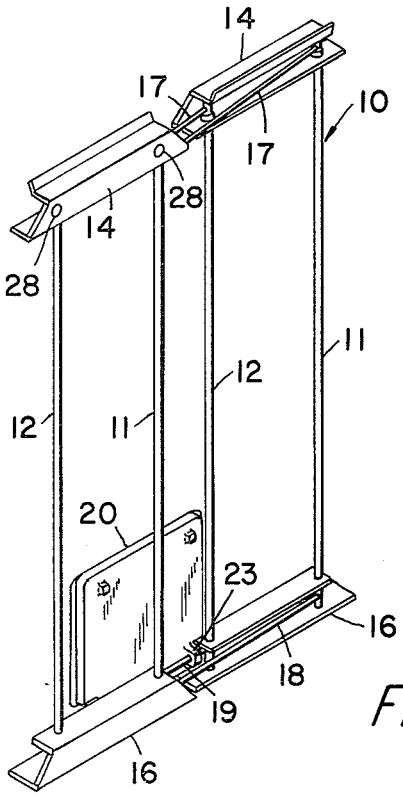
FIG. 3 is a perspective view of the pallet of FIG. 1 shown folded.

After the material which has been carried on the pallet 10 has been unloaded, the pallet may be readily folded up to be transported or stored. This is accomplished by folding the tray 20 upwardly to a position wherein it is substantially vertical and parallel to the back posts 12. The posts 11 and 12 are rotatably mounted or journaled to the side members 14 and base members 16 so that they can rotate with respect to these members. Therefore, when the tray 20 is in the vertical position, the pallet can be folded up simply by drawing a diagonally opposed front post 11 and back post 12 toward each other so that the pallet 10 folds up as shown in FIG. 3. When fully folded, the front posts 11 are nearly coplanar with the back posts 12. The pallet is prevented from folding up when it is in use since the tray 20, when in its horizontal position, will engage the posts 11 and 12 and prevent diagonally opposed posts from moving toward one another, thereby rigidifying the entire structure. Because the folded pallet is so compact and relatively light, after the load on the pallet has been removed and the pallet folded, it may be simply hung on a wall in its folded position until its use is required again.

Figure 4:
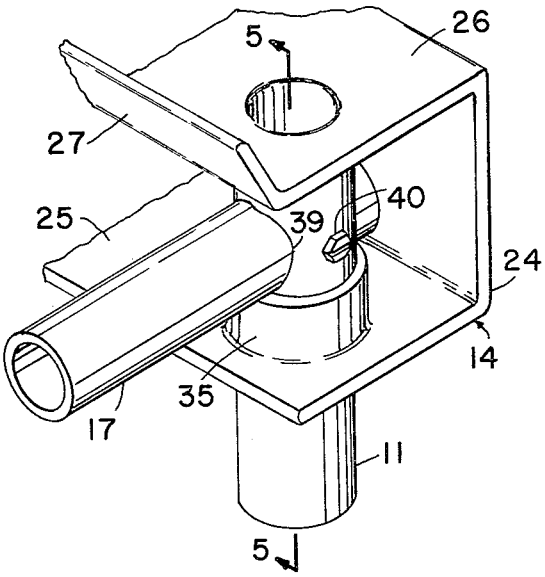
FIG. 4 is a detailed perspective view of the engagement between an upright post and the top side member of the pallet of FIG. 1.
Figure 5:
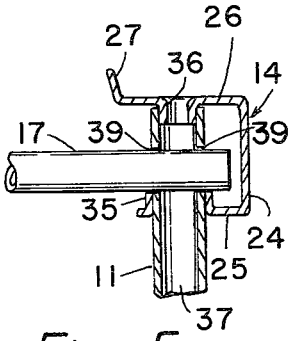
FIG. 5 is a cross-sectional view of the top side member and vertical post taken along the lines 5—5 of FIG. 4.

The rotatable mounting of each vertical post 11 to a top side member 14 is best illustrated with reference to the perspective view of FIG. 4 and the cross-sectional view of FIG. 5. The cylindrical post 11 passes upwardly through an opening in the lower horizontal flange 25 which is slightly larger than the outside diameter of the post. A ferrule 35 extends upwardly from the opening and has a cylindrical inside surface with an inside diameter slightly larger than the outside diameter of the post 11. Another ferrule 36 is formed on the upper flange 26 and extends downwardly concentric with the lower ferrule 35. As shown in FIG. 5, the post 11 is preferably tubular, having a cylindrical exterior surface and a cylindrical interior surface 37. The cylindrical outside surface of the ferrule 36 has a diameter slightly less than the inside diameter of the post 11. Thus, when the post 11 is inserted through the interior of the ferrule 35 and over the exterior surface of the ferrule 36, it is held between the two ferrules so that it cannont be moved laterally although it can rotate about its own axis. The front cross rod 17 may then be passed at its end through circular openings 39 in the post 11 which are located, when the post is fully inserted into the side member 14, at a position just above the top of the ferrule 35. The openings 39 are selected to be slightly larger than the outside diameter of the cross rod 17. The rod 17 may be secured to the post 11 by threading a fastening screw 40 through the side wall of the post 11 and into pressure contact with the cross rod 17. As best shown in FIG. 5, the cross rod 17 is fastened to the post at a position just above the top of the ferrule so that the post 11 will be held in place within the side member 14 and is prevented from being pulled out laterally by means of the rod 17 engaging the top of the ferrule 35. However, the post 11 can still rotate within the ferrules 35 and 36, thereby turning the cross rods 17 therewith.

The ferrules 35 and 36 may be formed in any convenient manner. One particularly simple and expeditious manner of forming the ferrules is to simply punch upwardly through the flange 25 with a circular punch to form the upturned ferrule 35, and similarly to punch downwardly through the top flange 26 to form the downwardly turned ferrule 36. If desired, any ragged edges formed during the punching process at the edges of the ferrules 35 and 36 may be removed by grinding.

It is also apparent that other means could be provided to hold the post 11 to the side member 14 if the cross rod 17 is mounted to the post 11 at another position. For example, a flange or collar could be mounted to the exterior of the post 11 just above the top of the ferrule 35, by a set screw, crimping, welding, etc., to prevent the post 11 from being pulled out along its axis.

The other front post 11 and the back posts 12 are rotatably mounted to the side members 14 in the same manner as described above and illustrated in FIGS. 4 and 5.

Figure 6:
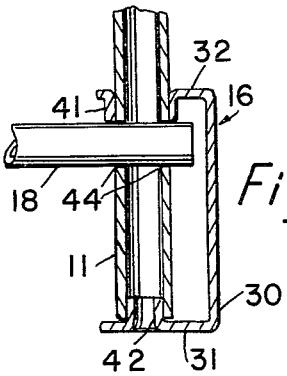
FIG. 6 is a cross-sectional view similar to FIG. 5 but taken through a base member showing the intersection of a cross rod and a vertical post.

The posts 11 and 12 are journaled to the base members 16 with a very similar structure. As shown in FIG. 6, for each post engaged to a base member, an opening is formed in the upper flange 32 of the member 16 which is slightly larger in diameter than the outside diameter of the post (illustrated with reference to a front post 11). A ferrule 41 extends downwardly from the opening in the upper flange 32 and has a cylindrical interior with a diameter slightly larger than the outside diameter of the post 11. Another cylindrical ferrule 42 is formed on the lower flange 31 of the member 16 and extends upwardly concentric with the upper ferrule 41. The cylindrical exterior surface of the lower ferrule 42 has a diameter slightly less than the inside diameter of the hollow, tubular post 11. The post 11 fits through the interior of the ferrule 41 and over the exterior of the ferrule 42 to prevent the post from moving laterally but allowing it to rotate about its axis. A lower cross rod (cross rod 18 shown) is passed through openings 44 in the post located just below the lower edge of the first ferrule 41. The cross rod 18 is secured to the post 11 within the holes 44 in the same manner as described above for the attachment of the cross rod 17 to the post 11, preferably by a fastening screw (not shown) passed through the wall of the post and into engagement with the cross rod 18. Again, the positioning of the rod 18 just beneath the bottom of the ferrule 41 prevents the post 11 from being drawn outwardly from the base member 16.

The other front post 11 and the back posts 12 are rotatably mounted or journaled to the base members 16 in the same manner and with the same structure as described above and shown in FIG. 6.

Figure 7:
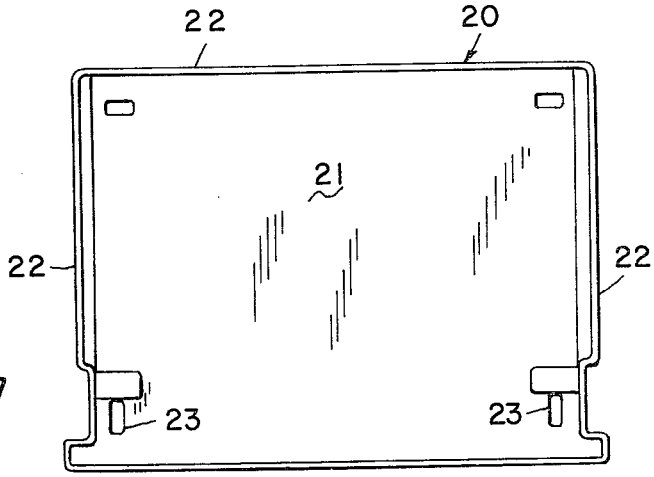
FIG. 7 is a plan view of the tray portion of the pallet of FIG. 1.

The tray 20 is shown in a plan view in FIG. 7. As illustrated therein, and in FIG. 1, the tray has a substantially, rectangular bottom panel 21 which is surrounded by a raised lip 22. To rigidify the trays, raise ribs (not shown) may be formed in the bottom panel 21. The tray is preferably made of a high strength plastic, such as high density polyethylene, and can be easily cleaned if it becomes soiled by the materials which are carried on the pallet. The tray is preferably molded with the lugs 23 formed integrally with the remainder of the tray (shown as indentations in the top view of FIG. 7).

The main structural members of the pallet 10, particularly the posts 11 and 12, the rods 17, 18 and 19, the top side members 14, and the base members 16 are preferably made of steel, treated for corrosion resistance such as by plating with chrome. These structural members may also be formed of other materials, such as aluminum, depending on the expected structural loading.

It is also noted that the pallet 10, as shown in FIG. 1, incorporates a minimum structure to accomplish the purpose of the pallet, which is particularly adapted to the carrying and stacking of bags of bulk material. The minimum structure for the pallet, which minimizes weight and expense in the finished product, comprises only the edges of a rectangular parallelepiped with the exception of the bottom tray 20 which covers the entire bottom of the pallet. However, it is apparent that walls could be provided on the pallet to restrain loose material carried by the pallet while still allowing the pallet 10 to fold up in the manner described above. For example, side walls could be hingedly attached to and between the posts 11 and 12, or, alternatively, could be rigidly attached to and extend between the top side members 14 and the base members 16. Front and back walls could be very simply formed by rigidly attaching them to, or forming them integrally with, the front posts 11 and back posts 12, respectively.

It is understood that the invention is not confined to the particular construction and arrangement of parts herein illustrated and described, but embraces such modified forms thereof as come within the scope of the following claims.

What is claimed is:

1. A folding pallet comprising:

(a) a pair of base members disposed in parallel relation;

(b) a pair of top side members disposed in parallel relation above the base members;

(c) a pair of front vertical posts rotatably mounted at their ends to the base members and top side members, one front post extending from one base member to the top side member above it and the other front post extending from the other base member to the other top side member above it, the posts being tubular, having a cylindrical exterior surface and a cylindrical interior surface;

(d) a pair of back vertical posts rotatably mounted at their ends to the base members and to the top side members, one back post extending from one base member to the top side member above it and the other back post extending from the other base member to the other top side member above it, the posts being tubular, having a cylindrical exterior surface and a cylindrical interior surface;

(e) a pair of top cross rods, one cross rod attached to and between the front posts near the top ends thereof and the other top cross rod attached to and between the back posts near the top ends thereof;

(f) a pair of bottom cross rods, one cross rod attached to and between the front posts near the bottom ends thereof and the other cross rod attached to and between the back posts near the bottom ends thereof;

(g) a bottom tray pivotally mounted to a bottom cross rod for rotation from a horizontal position in which the tray covers a substantial portion of the area at the bottom of the pallet between the front and back posts and a vertical position in which the tray is substantially parallel to the back posts, whereby the pallet may be folded from an erected position in which the posts, base members, top side members, and cross rods generally define the shape of a rectangular parallelepiped to a folded position by raising the tray from its horizontal to its vertical position and drawing either pair of diagonally opposite back posts and front posts toward each other until the pallet collapses to a substantially flat configuration;

wherein the top side members are formed as U-shaped channels, having a vertical web section and a horizontal lower flange and a horizontal upper flange extending therefrom, and each top side member including, for each vertical post rotatably mounted to the top side member, an opening in the lower horizontal flange which is slightly larger than the outside diameter of the post, through which the post passes, a ferrule on the lower flange extending upwardly from the opening and having a cylindrical interior with a diameter slightly larger than the outside diameter of the post, and another ferrule on the upper flange extending downwardly concentric with the lower ferrule and having an outside diameter which is slightly less than the inside diameter of the post, whereby each post will be held between the two ferrules with which it is engaged so that it cannot be moved laterally but can rotate about its own axis, and wherein the base members are formed as U-shaped channels having a central vertical web section and a horizontal lower flange and a horizontal upper flange extending therefrom, and each base member including, for each vertical post which is rotatably mounted to the base member, an opening in the upper flange of the base member which is slightly larger in diameter than the outside diameter of the post, through which the post passes, a ferrule on the upper flange extending downwardly from the opening and having a cylindrical interior with a diameter slightly larger than the outside diameter of the post, and a ferrule on the lower flange extending upwardly concentric with the ferrule on the upper flange and having a cylindrical exterior with a diameter slightly less than the inside diameter of the post, whereby each post will be held between the two ferrules with which it is engaged so that it cannot be moved laterally but can rotate about its own axis.

2. The folding pallet of claim 1 wherein the front and back posts have openings therein just above the ferrules on the lower flanges of the top side members and wherein the ends of the top cross rods extend through the openings in the respective front and back pairs of posts and are secured therein; and wherein the front and back posts have openings therein just below the ferrules on the upper flanges of the base members and wherein the ends of the bottom cross rods extend through the openings in the respective front and back pairs of posts and are secured therein, whereby the engagement of the cross rods to the posts prevents the posts from being pulled out of the top side members or the base members.

3. The folding pallet of claim 1 wherein the top side members each include a generally upright flange extending from the upper flange thereof along a portion of the length of the upper flange.

4. The folding pallet of claim 1 wherein the tray includes lugs extending from the bottom thereof with openings therein, and wherein the back bottom cross rod is cylindrical and passes through the openings in the extending lugs on the tray such that the tray can pivot about the back bottom cross rod from a horizontal position in which the tray rests its front end on the front bottom cross rod to a vertical position in which the tray is substantially parallel to and spaced outwardly from the back vertical posts so that the tray does not interfere with the folding of the pallet.

5. A folding pallet having a plurality of frame members arranged and connected together to generally define the shape of a rectangular parallelepiped when the pallet is in erected configuration, the frame members including:

(a) a pair of tubular front vertical posts disposed in parallel relation, each having cylindrical interior and exterior surfaces;

(b) a pair of tubular back vertical posts disposed in parallel relation to one another and to the front posts, each having cylindrical interior and exterior surfaces;

(c) a pair of base members disposed in parallel relation, one base member engaged to the bottom ends of one front post and one back post, and the other base member engaged to the bottom ends of the other front post and other back post, the base members formed as U-shaped channels having a central vertical web section and a horizontal lower flange and a horizontal upper flange extending therefrom, each base member including, for each vertical post which is engaged to the base member, an opening in the upper flange of the base member which is slightly larger in diameter than the outside diameter of the post, through which the post passes, a ferrule on the upper flange extending downwardly from the opening and having a cylindrical interior with a diameter slightly larger than the outside diameter of the post, and a ferrule on the lower flange extending upwardly concentric with the ferrule on the upper flange and having a cylindrical exterior with a diameter slightly less than the inside diameter of the post, whereby each post will be held between the two ferrules so that it cannot be moved laterally but can rotate about its own axis;

(d) a pair of top side members disposed in parallel relation above the base members and engaged to the vertical posts, one top side member engaged to one front post and one back post and the other top side member engaged to the other front post and the other back post, the top side members formed as U-shaped channels having a vertical web section and a horizontal lower flange and a horizontal upper flange extending therefrom, and each top side member including, for each vertical post engaged to the top side member, an opening in the lower horizontal flange which is slightly larger than the outside diameter of the post, through which the post passes, a ferrule on the lower flange extending upwardly from the opening and having a cylindrical interior with a diameter slightly larger than the outside diameter of the post, and another ferrule on the upper flange extending downwardly concentric with the lower ferrule and having an outside diameter which is slightly less than the inside diameter of the post, whereby each post will be held between the two ferrules with which it is engaged so that it cannot be moved laterally but can rotate about its own axis.

6. The folding pallet of claim 5 including a pair of top cross rods, one top cross rod attached to and between the front post near the top ends thereof and the other top cross rod attached to and between the back posts near the top ends thereof; and a pair of bottom cross rods, one bottom cross rod attached to and between the front posts near the bottom ends thereof and the other bottom cross rod attached to and between the back post near the bottom ends thereof.

7. The pallet of claim 5 including a bottom tray pivotally mounted to the frame members of the pallet for rotation from a horizontal position in which the tray covers a substantial portion of the area at the bottom of the pallet between the front and back posts and a vertical position in which the tray is substantially parallel to the back posts.

8. The folding pallet of claim 6 including a bottom tray having lugs extending from the bottom thereof with openings therein, and wherein the back bottom cross rod is cylindrical and passes through the openings in the extending lugs on the tray such that the tray can pivot about the back bottom cross rod from a horizontal position in which the tray rests its front end on the front bottom cross rod to a vertical position in which the tray is substantially parallel to and spaced outwardly from the back vertical posts so that the tray does not interfere with the folding of the pallet.

9. The folding pallet of claim 6 wherein the front and back posts have openings therein just above the ferrules on the lower flanges of the top side members and wherein the ends of the top cross rods extend through the openings in the respective front and back pairs of posts and are secured therein and wherein the front and back posts have openings therein just below the ferrules on the upper flanges of the base members and wherein the ends of the bottom cross rods extend through the openings in the respective front and back pairs of posts and are secured therein whereby the engagement of the cross rods to the posts prevents the posts from being pulled out of the top side members or the base members.

10. The folding pallet of claim 5 wherein the top side members each include a generally upright flange extending from the upper horizontal flange thereof along a substantial portion of the length of the upper flange.

11. A folding pallet comprising:

(a) a pair of tubular front vertical posts disposed in parallel relation, each having cylindrical interior and exterior surfaces;

(b) a pair of tubular back vertical posts disposed in parallel relation to one another and to the front posts, each having cylindrical interior and exterior surfaces;

(c) a pair of base members disposed in parallel relation, one base member engaged to the bottom ends of one front post and one back post, and the other base member engaged to the bottom ends of the other front post and other back post, the base members formed as U-shaped channels having a central vertical web section and a horizontal lower flange and a horizontal upper flange extending therefrom, each base member including, for each vertical post which is engaged to the base member, an opening in the upper flange of the base member which is slightly larger in diameter than the outside diameter of the post, through which the post passes, a ferrule on the upper flange extending downwardly from the opening and having a cylindrical interior with a diameter slightly larger than the outside diameter of the post, and a ferrule on the lower flange extending upwardly concentric with the ferrule on the upper flange and having a cylindrical exterior with a diameter slightly less than the inside diameter of the post, whereby each post will be held between the two ferrules so that it cannot be moved laterally but can rotate about its own axis;

(d) a pair of top side members disposed in parallel relation above the base members and engaged to the vertical posts, one top side member engaged to one front post and one back post and the other top side member engaged to the other front post and the other back post, the top side members formed as U-shaped channels having a vertical web section and a horizontal lower flange and a horizontal upper flange extending therefrom, and each top side member including, for each vertical post engaged to the top side member, an opening in the lower horizontal flange which is slightly larger than the outside diameter of the post, through which the post passes, a ferrule on the lower flange extending upwardly from the opening and having a cylindrical interior with a diameter slightly larger than the outside diameter of the post, and another ferrule on the upper flange extending downwardly concentric with the lower ferrule and having an outside diameter which is slightly less than the inside diameter of the post, whereby each post will be held between the two ferrules with which it is engaged so that it cannot be moved latarally but can rotate about its own axis;

(e) a pair of top cross rods, one cross rod attached to and between the front posts at a position just above the ferrules on the top side members, and the other top cross rod attached to and between the back posts at a position just above the ferrules on the top side members;

(f) a pair of bottom cross rods, one cross rod attached to and between the front posts at a position just below the ferrules on the base members, and the other cross rod attached to and between the back posts at a position just above the ferrules on the base members;

(g) a bottom tray pivotally mounted to a bottom cross rod for rotation from a horizontal position in which the tray covers a substantial portion of the area at the bottom of the pallet between the front and back posts and a vertical position in which the tray is substantially parallel to the back posts, whereby the pallet may be folded from an erected position in which the posts, base members, top side members and cross rods generally define the shape of a rectangular parallelepiped to a folded position by raising the tray from its horizontal to its vertical position and drawing either pair of diagonally opposite back posts and front posts toward each other until the pallet collapses to its substantially flat configuration.

12. The folding pallet of claim 11 wherein the tray has lugs extending from the bottom thereof with openings therein, and wherein the back bottom cross rod is cylindrical and passes through the openings in the extending lugs on the tray such that the tray can pivot about the back bottom cross rod from a horizontal position in which the tray rests its front end on the front bottom cross rod to a vertical position in which the tray is substantially parallel to and spaced outwardly from the back vertical posts so that the tray does not interfere with the folding of the pallet.

13. The folding pallet of claim 11 wherein the top side members each include a generally upright flange extending from the upper horizontal flange thereof along a substantial portion of the length of the upper flange.

* * * * *